United States Patent [19]

Tsuji et al.

[11] 3,945,898

[45] Mar. 23, 1976

[54] METHOD FOR COATING METAL SURFACE WITH CARBON

[75] Inventors: Rokuro Tsuji, Chiba; Toshinori Niwa, Mobara, both of Japan

[73] Assignee: Hitachi, Ltd., Japan

[22] Filed: Sept. 19, 1973

[21] Appl. No.: 398,790

[30] Foreign Application Priority Data

Sept. 20, 1972 Japan ..... 47-93603
Sept. 20, 1972 Japan ..... 47-93604
Sept. 20, 1972 Japan ..... 47-93605

[52] U.S. Cl. ..... 204/181
[51] Int. Cl.[2] ..... C25D 13/02; C25D 13/10
[58] Field of Search ..... 204/181

[56] References Cited

UNITED STATES PATENTS

| | | | |
|---|---|---|---|
| 3,037,923 | 6/1962 | Gnau | 204/181 |
| 3,493,482 | 2/1970 | Irwin | 204/181 |
| 3,629,086 | 12/1971 | Brewer et al. | 204/181 |
| 3,783,025 | 1/1974 | King et al. | 204/181 |

*Primary Examiner*—Howard S. Williams
*Attorney, Agent, or Firm*—Craig & Antonelli

[57] ABSTRACT

Uniform and strong carbon film can be formed on a surface of a metal substrate or metallized substrate without damaging optical, thermal and electrical characteristics which are original to carbon surface by electrodepositing the carbon film on the substrate from electrodepositing liquid containing carbon and water soluble electrodepositing resin and then heat treating the carbon film to decompose and release said resin.

15 Claims, 4 Drawing Figures

METHOD FOR COATING METAL SURFACE WITH CARBON

BACKGROUND OF THE INVENTION

The present invention relates to an improved method for coating carbon on the surface of a metal substrate or a metallized substrate. Furthermore, it concerns with parts of electron tube having black carbon coating on their surface and a method for production thereof. Thus, obtained carbon coated part of electron tube such as anodes, grids or shadow masks cause little generation of gases, are excellent in heat radiation efficiency, have extremely small secondary electron emission ratio and do not lose strong adhesiveness even at a high temperature of about 1,000° C.

As the method for coating a metal surface with carbon, there has been known such method as applying a suspension of carbon using water glass as a binder by brushing or spraying. However, according to this method using water glass as a binder, the adhesiveness between the metal surface and carbon depends greatly upon the characteristic of the water glass. For example, when concentration of said water glass is high, said adhesiveness is great, but since the surface of carbon particles is protected by the water glass, the surface of the carbon layer cannot sufficiently exhibit the effect which it originally possesses. On the other hand, when concentration of said water glass is low, the adhesiveness between the metal surface and the carbon layer is small and the carbon layer is apt to separate from the metal surface.

SUMMARY OF THE INVENTION

The object of the present invention is to provide an improved method for forming a strong coating of carbon on a surface of a metal substrate and the like without damaging optical, thermal and electrical characteristics which a carbon surface originally possesses.

Another object of the present invention is to provide a method for forming a carbon coating layer in a uniform thickness on various molded metal materials having complicated shapes.

Further object of the present invention is to provide parts of electron tube by molding said carbon coated metal substrates or metallized substrates into the shapes of parts of electron tube.

The gist of the present invention resides in a step of forming a carbon film on a metal substrate and the like by the cataphoretic electrodeposition method (referred to as electrodeposition method hereinafter) and a step of heat treating said film for heat decomposition and removal of organic resins contained in said carbon film.

DESCRIPTION OF THE PREFERRED EMBODIMENT

The present invention will be specifically explained with reference to the drawings.

Figure 1:
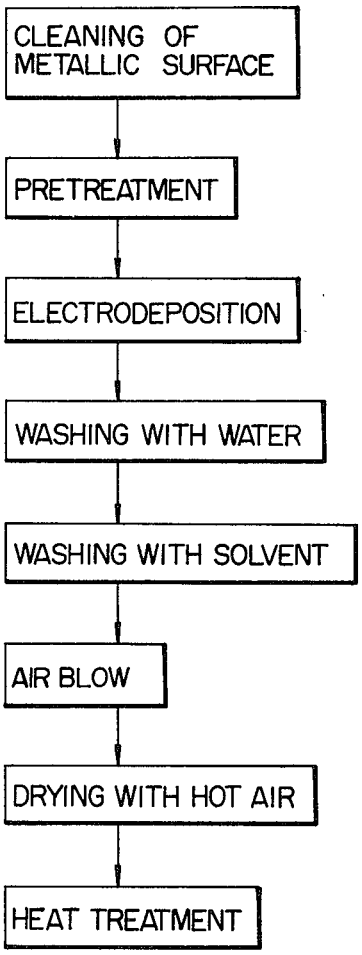
FIG. 1 is a basic flowsheet for practicing the method of the present invention.

FIG. 1 illustrates the basic steps which constitute the method of the present invention. The metal substrate to which the method of the present invention is applicable include all metal plates such as iron plates, nickel plates, stainless steel plates, titanium plates, copper plates, aluminum plates, etc. Furthermore, the present method is also applicable to chromium plated, zinc plated and nickel plated metal substrates and metallized non-metallic materials. The selection of such substrates rather depends on purpose for use thereof. For example, when thermal resistance is required, the selection should be made in accordance with oxidation and reduction reactivity and cementation of the surface of the metal substrates.

Next, the electrodepositing liquid used in the present invention is such that obtained by adding a water soluble electrodepositing resin as a vehicle to carbon or graphite carbon and dispersing it in an aqueous solution. Said water soluble electrodepositing resins are those which are generally used in the paint industry such as alkyd resins, acrylic resins, phenol resins, melamine resins which are rendered water soluble. These resins may be used alone or in combination of two or more. The composition of the electrodepositing liquid are suitable 0.4–12% by weight of carbon and 1–18% by weight of vehicle and when the compositions are outside said ranges, there are difficulties in thickness, uniformity, adhesion strength of the electrodeposition film and electrodepositing time.

Suitable electrodeposition conditions are as follows: deposition voltage of 30–250 V (DC) and deposition time of more than about 1/10 second, preferably less than 5 minutes, more preferably less than 2 minutes.

The thickness of electrodeposited film depends on said conditions such as compositions of the electrodepositing liquid, electrodeposition voltage and electrodeposition time and it is possible to optionally adjust the thickness in the range of 3 $\mu$ –70 $\mu$.

Since the electrodeposited film of the present invention contains the vehicles such as alkyd resins, etc. besides carbon as mentioned above, it is necessary to remove the gas releasing component by heat decomposition. However, if it is previously known that the metal substrate having the electrodeposited film is to be heat treated under the conditions corresponding to or severer than the heat treating conditions of the present invention at later stage after being assembled into an article, the heat treatment of the present invention may be omitted.

The furnace used for the heat treatment in the present invention may be any of oxidizing or inert atmosphere, but in case of high temperature treatment, inert atmosphere is preferred. The heat treating time is one hour when the heat treating temperature is about 350°C and about 5 minutes is sufficient when the temperature is 800°C. Under these heat treating conditions, organic resins contained in the film of a thickness within said range is nearly completely decomposed. The range of the heat treating temperature will be explained. In order to heat-decompose the vehicle, at least 300°C is required even in case of the vehicle having low heat decomposition temperature such as acrylic resin. Regarding the maximum temperature, in case of finely powdered carbon or graphite which has good dispersibility, it is oxidized and decomposed at a temperature of higher than 1,000°C. Therefor, the heat treating temperature is suitably about 300°–1,000°C. A conveyer furnace can also be used, but since when travelling speed of conveyer is high, namely, speed of temperature elevation is too high, the organic resin in the film is rapidly heat decomposed and the carbon layer is apt to separate from metal plate, careful consideration should be given on heating rate. Furthermore, the similar consideration must also be given on cooling rate. When the cooling rate is too high and density of the carbon layer is high, difference in thermal expansion coefficient of the metal substrate and that of the carbon layer is great and separation of the carbon layer is also caused. According to the inventor's experiments, heating and cooling rates are preferably lower than 70°C/min.

Figure 2:
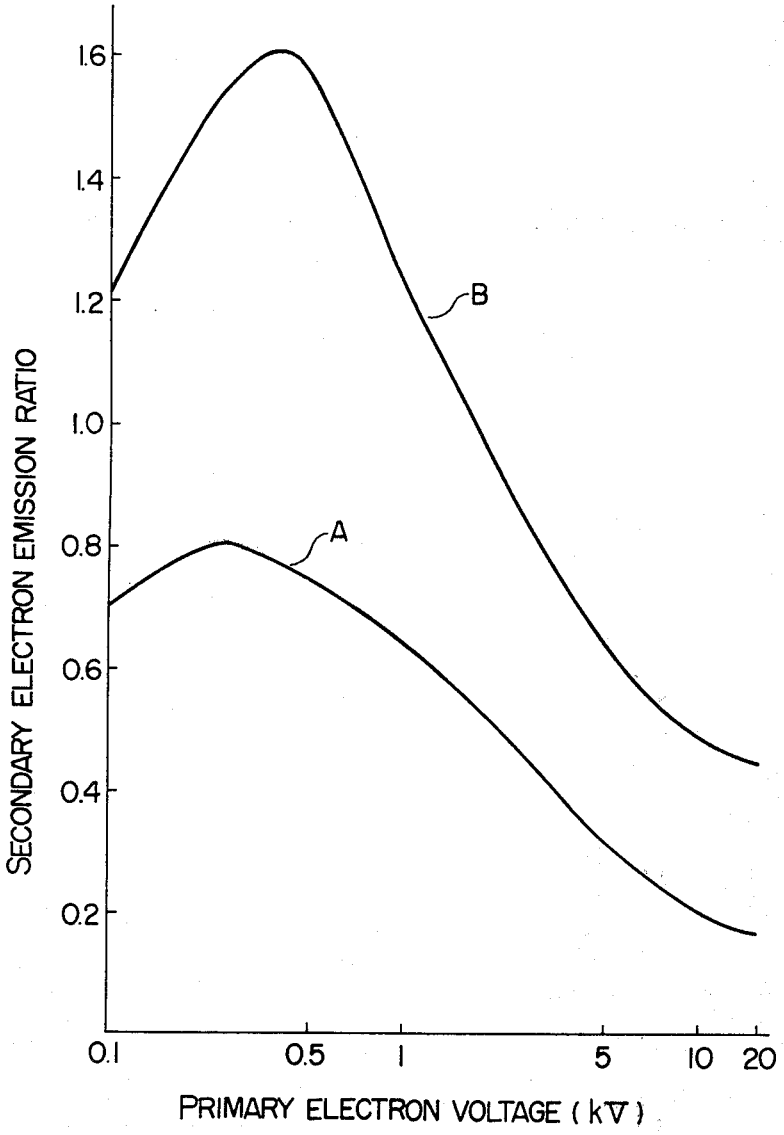
FIG. 2 is a graph which shows the effect obtained by practicing the method of the present invention that is, it compares secondary electron emission ratio to primary electron voltage of an iron plate coated with carbon according to the present invention and that of an iron plate having no carbon coating.

FIG. 2 shows one of the effects obtained by the method of the present invention. That is, it shows the comparison of secondary electron emission ratio to primary electron voltage of iron plate deposited with carbon in accordance with the present invention and an iron plate having no carbon coating. As is clear from FIG. 2, the carbon deposited plate A of the present invention exhibits secondary electron emission ratio to each primary electron voltage which is about 50% lower than that of the plate B having no carbon layer.

Figure 3:
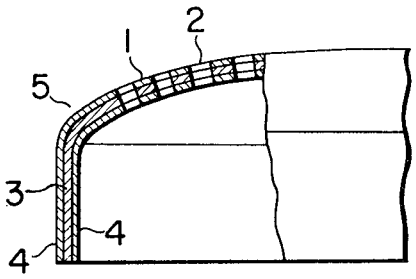
FIG. 3 is a cross sectional view of a part of electrode for electron tube obtained by the present invention.

FIG. 3 is a cross sectional view of a color selection electrode which is one embodiment of electrode parts obtained by the method of the present invention. In this FIG. 3, 1 is an opening through which a number of electron beam passing holes 2 are excavated, 3 is a skirt part, and 4 is a carbon layer deposited on the whole surface of said opening 1 and skirt part 3.

Figure 4:
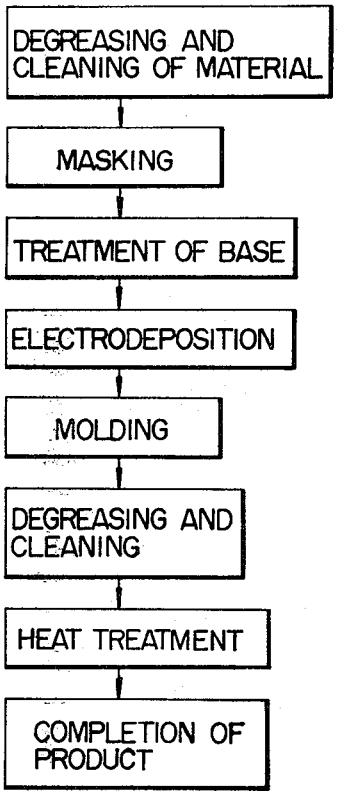
FIG. 4 is a flow-sheet for production of parts of electron tube in accordance with the present invention.

FIG. 4 is a flowsheet of production of parts of electron tube in accordance with the present invention. According to one embodiment of production of electron tube parts as shown in FIG. 4, firstly surface of material for electron tube parts having electrodepositable shape and made of electrodepositable material such as iron plate, stainless steel, etc. was degreased with trichlene for rustproofing and cleansed with a surface active agent. Then, the portions to be welded were masked not to be electrodeposited and then the surface was subjected to surface conditioning by pretreatment. Then, thus treated material was dipped in an electrodepositing liquid obtained by mixing about 0.5–4% by weight of carbon powders, about 1–15% by weight of a water soluble organic resin binder and water and electrodeposition was carried out by applying a DC voltage of 60–200 V for 3 minutes to form an electrodeposited film comprising a mixture of carbon powders and the binder on the surface of the material. Furthermore, this film was baked at 130–180°C for 30 minutes to heat-cure the film to render it hard.

Thereafter, thus obtained material having the electrodeposited film on its surface was molded into the shapes of electron tube parts by cutting and pressing. The drawability and pressability were excellent and the film was never separated from the substrate.

Furthermore, after removal of cutting oil and metal dusts which sticked to the electrodeposited film in molding, the film was subjected to the heat treatment to cause heat decomposition of binder to eliminate it.

As is clear from the above explanation, according to the present invention, electron tube parts having carbon layer on the surface which has a uniform thickness and a strong adhesion power even when the thickness is greater than the conventional electrodeposited film can be efficiently produced.

The present invention will be illustrated in the following Examples.

EXAMPLE 1

Using an electrodepositing liquid having the composition of 3% by weight of carbon powders (average particle size 35 mμ), 18% by weight of alkyd resin and 87% by weight of water, electrodeposition was carried out on a degreased and pretreated iron plate (surface area about 80 $cm^2$) for 40 seconds under a voltage of DC 100 V and then the film was subjected to washing with water, washing with solvent, air blow and hot air drying. Then, the electrodeposited film was heat treated in an electric furnace at 400°C for 30 minutes to obtain an extremely strong jet-black carbon film of 20 μ in thickness. When said iron plate was in the form of a shadow mask, the same carbon film as obtained above was also formed thereon.

EXAMPLE 2

Using an electrodepositing liquid having a composition of 12% by weight of carbon powders (average particle size 0.2 μ), 2% by weight of acrylic resin and 85% by weight of water, electrodeposition was carried out on a degreased titanium plate (surface area about 80 $cm^2$) for 5 minutes under a voltage of DC 30 V and then the electrodeposited film was subjected to washing with water, washing with solvent, air blow and hot air drying. Thereafter, the electrodeposited film was heat treated in a reducing furnace at 700°C for 10 minutes to obtain a carbon film having irregular surface of 5 μ in thickness. When said titanium plate was in the form of an anode, the same carbon film as obtained above was also formed thereon.

EXAMPLE 3

Using an electrodepositing liquid having compositions of 4% by weight of graphite paste (Aquadag), 9% by weight of phenol resin and 87% by weight of water, electrodeposition was carried out on an nickel plated and degreased copper plate (surface area 400 $cm^2$) for 10 seconds under a voltage of DC 200 V and the electrodeposited film was subjected to washing with water, washing with solvent and air blow. Thereafter, thus electrodeposited film was heat treated in a furnace of oxidizing atmosphere at 450°C for 30 minutes to obatin a carbon film having a smooth surface of 12 μ in thickness. When said nickel plated copper plate was in the form of an anode, the same carbon film as obtained above was also formed thereon.

EXAMPLE 4

Using the same electrodepositing liquid as used in the Example 3, electrodeposition was carried out on the cleaned and pretreated surface of iron plate photoetching part (surface area about 750 $cm^2$) for 30 seconds under a voltage of 100 V. Thereafter, thus electodeposited film was washed with water and subjected to air blowing and then was heat treated in an $N_2$ gas atmosphere in which $N_2$ gas was passed at a rate of 300 l/min at 550°for 30 minutes to obtain a strong carbon film of 14 μ in thickness. When said iron plate was in the form of a shadow mask, the same carbon film as obtained above was also obtained thereon.

EXAMPLE 5

Using an electrodepositing liquid having a composition of 10% of maleinized oil resin, 2% of carbon and 88% of water, electrodeposition was carried out on an iron plate (surface area 1200 $cm^2$) subjected to degreasing, cleaning, masking and pretreatment at DC of 50 V for 30 seconds. The electrodeposited film was subjected to baking at 170°C for 20 minutes and the plate was molded into an electrode. The surface of this electrode stained by the molding was degreased and then was heat treated at 450°C for 10 minutes to obtain the electrode coated with a carbon film of 5 $\mu$ in thickness having the similar properties to those mentioned above.

What is claimed is:

1. A method for coating a surface of a metal or a metallized body to form a substantially pure carbon coating thereon comprising treating said surface with an aqueous electrodepositing liquid consisting essentially of carbon and at least one water soluble organic resin to form an electrodeposited carbon film on said surface and heat treating said carbon film at a temperature of about 300° to 1,000°C. to substantially completely decompose the organic resin in said carbon film.

2. A method according to claim 1, wherein said water soluble organic resin is at least one selected from alkyd resin, acrylic resin, phenol resin and melamine resin.

3. A method according to claim 1, wherein said electrodepositing liquid comprises 0.4–12% by weight of carbon 1–18% by weight of the water soluble organic resin and the balance of water.

4. A method according to claim 1, wherein conditions for electrodeposition are as follows: a voltage of 30–250 V (DC), time of 1/10 second - 5 minutes and a thickness of 3 $\mu$ –70 $\mu$.

5. A method according to claim 1, wherein the material to be coated with carbon is molded electron tube part.

6. Electron tube parts produced by the method of claim 5.

7. A method according to claim 1, wherein thus obtained metal or metallized body having carbon film is molded into a shape of electron tube part.

8. A method according to claim 1, wherein said carbon film is heated up to said temperature at a rate lower than about 70°C/min., and further wherein said carbon film is cooled from said temperature after heat treatment at a cooling rate of lower than about 70°C/min.

9. A method according to claim 8, wherein said electrodepositing liquid comprises 0.4–12% by weight of carbon, 1–18% by weight of the water soluble organic resin and the balance of water.

10. The product of the process of claim 9.

11. A method according to claim 9, wherein the surface of a molded electron tube part is coated with said carbon film.

12. The product of the process of claim 11.

13. A method according to claim 8, wherein the electrodepositing liquid applied to said surface is dried to form said carbon film prior to heat treatment.

14. A method according to claim 13, wherein said electrodepositing liquid is dried by heating.

15. A method according to claim 8, wherein sufficient electrodepositing liquid is applied to said surface so that the thickness of said carbon film is about 3$\mu$ to about 70$\mu$.

* * * * *